US006955037B2

(12) United States Patent
Weide et al.

(10) Patent No.: US 6,955,037 B2
(45) Date of Patent: Oct. 18, 2005

(54) OPEN-END SPINNING DEVICE

(75) Inventors: Thomas Weide, Mönchengladbach (DE); Lothar Winzen, Erkelenz (DE)

(73) Assignee: Saurer GmbH & Co. KG., Monchengladbach (DE)

( * ) Notice: Subject to any disclaimer, the term of this patent is extended or adjusted under 35 U.S.C. 154(b) by 44 days.

(21) Appl. No.: 10/719,957

(22) Filed: Nov. 21, 2003

(65) Prior Publication Data

US 2004/0103635 A1 Jun. 3, 2004

(30) Foreign Application Priority Data

Nov. 21, 2002 (DE) ..... 102 54 271

(51) Int. Cl.[7] ..... D01H 4/10
(52) U.S. Cl. ..... 57/404; 57/417
(58) Field of Search ..... 57/404–417

(56) References Cited

U.S. PATENT DOCUMENTS

| | | | | |
|---|---|---|---|---|
| 3,958,403 | A | 5/1976 | Wehling | 57/58.89 |
| 5,540,044 | A | 7/1996 | Raasch | 57/417 |
| 2004/0103634 | A1 * | 6/2004 | Weide et al. | 57/417 |

FOREIGN PATENT DOCUMENTS

| | | | |
|---|---|---|---|
| DE | 1 917 864 | A1 | 11/1969 |
| DE | 2 126 841 | | 5/1971 |
| DE | 24 21 415 | A1 | 6/1975 |
| DE | OS 25 52 955 | A1 | 12/1976 |
| DE | 39 42 454 | A1 | 6/1991 |
| DE | 44 11 342 | A1 | 5/1995 |
| DE | 195 28 727 | C2 | 8/1996 |
| DE | 199 63 087 | A1 | 6/2001 |

OTHER PUBLICATIONS

European Search Report.
German Search Report

* cited by examiner

*Primary Examiner*—John J. Calvert
*Assistant Examiner*—Shaun R. Hurley
(74) *Attorney, Agent, or Firm*—Kennedy Covington Lobdell & Hickman, LLP

(57) ABSTRACT

An open-end spinning device comprises a spinning rotor (21) rotating in a rotor housing with a spinning insert (24) supported rotatably with respect to the spinning rotor (21) coaxially to the rotor axis (33). The spinning insert (24) can be caused to rotate as a function of the rotary motion of the spinning rotor (21) via a contactless entrainment of the spinning insert (24) by means of permanent magnets (32) attached to the spinning insert (24). In this manner a simple and reliable entrainment and an automatic adjusting of the rotational speed of the spinning insert (24) in the spinning rotor (21) are achieved.

5 Claims, 2 Drawing Sheets

OPEN-END SPINNING DEVICE

CROSS-REFERENCES TO RELATED APPLICATIONS

This application claims the benefit of German patent application 10254271.6 filed Nov. 21, 2002, herein incorporated by reference.

BACKGROUND OF THE INVENTION

The present invention relates to an open-end spinning device having a spinning rotor rotating in a rotor housing with a spinning insert arranged rotatably supported within the spinning rotor coaxially to the rotor axis.

German Patent Publication DE-OS 25 52 955 teaches rotatably supporting a spinning insert inside the spinning rotor of an open-end spinning device. The rotor shaft of the spinning rotor is designed as a hollow shaft and rotates on a support disk mounting. The drive and bearing shaft of the spinning insert is supported in the hollow shaft by roller bearings. The spinning rotor and the spinning insert are driven by a common tangential belt. In order to achieve a necessary speed difference between the spinning rotor and the spinning insert in such rotor spinning devices, the drive whorls of the two shafts have different dimensions. This open-end spinning device is intended to be able to eliminate disadvantages in the nature of the rotor spun yarn such as, e.g., reduced yarn strength, that are inherent in a yarn produced with this spinning method in contrast to the ring spinning method. However, open-end rotor spinning devices of this type have not proven themselves in practice.

German Patent Publication DE 44 11 342 A1 also describes an open-end spinning device with a spinning insert rotatably supported in the spinning rotor. The spinning insert can be intermittently fixed on the spinning rotor via a coupling device. In normal spinning operation the spinning insert is driven by the rotating shank of the yarn being spun. It is possible by means of the coupling device to accelerate the spinning insert to the rotor speed in the acceleration phase of the spinning device in that the spinning insert is entrained by the spinning rotor. This avoids an overloading of the yarn during a piecing operation that could result in a yarn break or in a failure of the piecing operation. The coupling is designed as a centrifugal coupling or, alternatively, as an electromagnetic coupling with a frictional contact between the spinning rotor and the spinning insert via spring elements. The time of the entrainment of the spinning insert by the spinning rotor must be adjusted in a defined manner and subsequently corrected if necessary. A disadvantageous roughening of the surface and wearing over a long period of operation can occur on the spring elements and the spinning rotor. A release of the coupling and thereby the cancellation of frictional contact connecting the spinning rotor and the spinning insert can not be coordinated to the extent desired exactly with the time of the piecing-up of the yarn during the piecing process. After the piecing of the yarn, the coupling must be released in order that different rotational speeds of the spinning rotor and of the spinning insert are possible. If the coupling is released too late, this can result in a defective yarn piecing.

SUMMARY OF THE INVENTION

In view of the above-described state of the art, it is accordingly an object of the present invention to provide an improved open-end rotor spinning device.

The invention addresses this objective by providing an open-end spinning device basically having a rotor housing, a spinning rotor disposed for rotation in the rotor housing for receiving the fibers to be spun into the yarn, and a spinning insert rotatably supported coaxially with respect to the spinning rotor. According to the present invention, a coupling device is provided for contactlessly imparting rotation to the spinning insert as a function of rotation of the spinning rotor for rotation of the spinning insert at a different speed from the spinning rotor under the influence of a shank of the yarn being spun.

An open-end spinning device designed in accordance with the invention is not exposed to any wearing or scratching of the surface of the spinning rotor with the potential consequence of undesired accumulations of fiber or dust in the rotor. No additional drive devices or control devices for driving or coupling are required.

The entrainment of the spinning insert is preferably accomplished via permanent magnets in a particularly simple manner and with little expense. The permanent magnets may advantageously be fastened to the spinning insert in a non-detachable manner. The space requirement of the permanent magnets is small. They can be readily integrated into the spinning insert and require no additional construction space. This is particularly advantageous because the available construction space inside the spinning rotors is very limited.

In a preferred embodiment, the spinning insert rotatable freely inside the spinning rotor may also preferably comprises a guide conduit for the yarn to be withdrawn, with the guide conduit preferably having a curvature in the direction of rotation of the spinning rotor. The spinning insert is consequently advantageously and reliably entrained by the yarn and the yarn is relatively protected. The free yarn end of the joining yarn also extends through the guide conduit in the joining process during its introduction.

Additional details, features and advantages of the present invention will be described in the exemplary embodiments disclosed in the following specification with reference to the accompanying drawing figures.

DESCRIPTION OF THE PREFERRED EMBODIMENT

Figure 1:
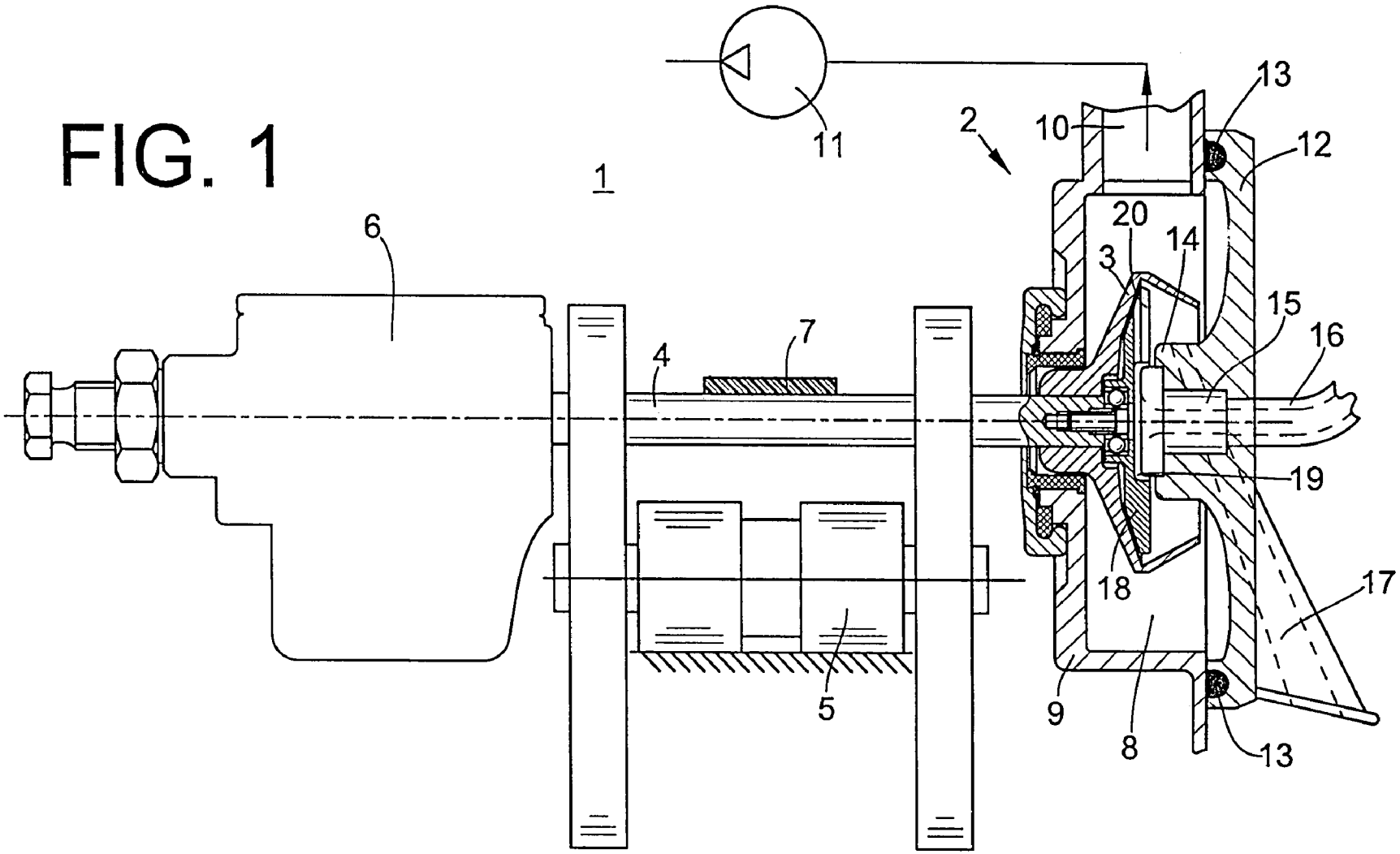
FIG. 1 is a partially sectioned schematic side elevational view of an open-end rotor spinning device with a spinning insert arranged inside the spinning rotor.

Referring now to the accompanying drawings and initially to FIG. 1, an open-end spinning device 1 comprises spinning rotor 2 which has a rotor plate 3 and a rotor shaft 4. Rotor shaft 4 is mounted in a support disk bearing arrangement 5 and is fixed in the axial direction by an axial support 6. Spinning rotor 2 is driven by an endless flat belt 7. A rotor housing 9 forms a vacuum chamber 8 in which a rotor plate 3 rotates. Rotor housing 9 communicates via a vacuum line 10 with a vacuum source 11 and is closed airtight during spinning operation by a conduit plate 12 with the aid of a ring seal 13. Conduit plate 12 has a conduit plate continuation 14 in which a yarn withdrawal nozzle 15 and a yarn withdrawal tube 16 are held. The individual fibers of an opened sliver are pneumatically transported via a fiber guide conduit 17 into the rotor plate 3. A spinning insert 18 is rotatably arranged on the rotor shaft 4 inside the rotor plate 3. The spinning insert 18 has a recess 19 on its front side into which yarn withdrawal nozzle 15 extends. A yarn guide conduit 20 extends essentially radially from the recess 19 to the outer edge of the spinning insert 18.

Figure 2:
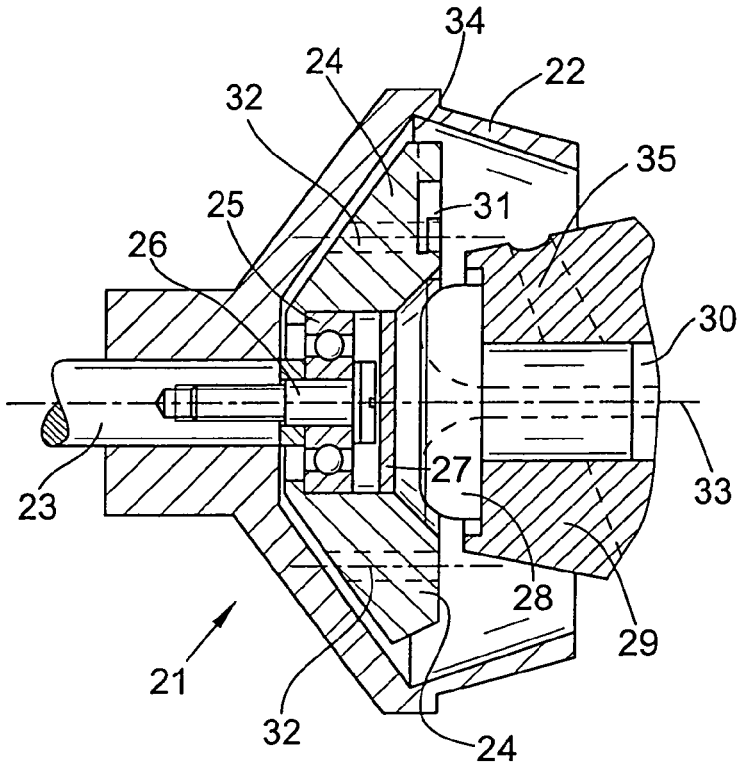
FIG. 2 is a cross-sectional view of an open-end rotor spinning device with a spinning insert in association with a coupling device in accordance with the present invention.

FIG. 2 is an enlarged partial view of an open-end spinning device in accordance with the present invention with a spinning rotor 21. A spinning insert 24 is rotatably supported on a rotor shaft 23 by a roller bearing 25 in a rotor plate 22 of the spinning rotor 21. Roller bearing 25 is fastened by its inner ring on the rotor shaft 23 with the aid of a screw bolt 26. The roller bearing 25 and the screw bolt 26 are closed against a yarn withdrawal nozzle 28 by a cover disk 27. Yarn withdrawal nozzle 28 is fastened on a conduit plate continuation 29. A yarn withdrawal tube 30 follows the yarn withdrawal nozzle 28. Spinning insert 24 is formed with a yarn guide conduit 31. Spinning insert 24 also comprises four cylindrical permanent magnets 32 arranged diametrically to one another and at the same spacing from the rotor axis 33.

As is known, open-end rotor spinning devices are restarted in spinning operation after a yarn break by an automatically operating joining carriage such as is described, e.g., in German Patent Publication DE 44 11 342 A1 and its corresponding U.S. Pat. No. 5,540,044. In the joining carriage, an appropriately prepared yarn end is introduced through the yarn withdrawal tube 30 into the spinning rotor 21. The yarn end passes via the yarn guide conduit 31 of the spinning insert 24 rotating with spinning rotor 21 to a circumferential fiber collection groove 34 of the spinning rotor 21 and the yarn end is connected thereat with a ring of fibers formed by centrifugal collection of individual opened fibers pneumatically delivered through fiber guide conduit 35 into rotor plate 22 for forming the fibers into the yarn.

If the spinning rotor 21 is caused to rotate for the spinning operation in the direction of arrow 36, the spinning insert 24 is entrained by the magnetic action of permanent magnets 32 and rotates in the same direction as the spinning rotor 21 in the direction of the arrow 37.

Figure 3:
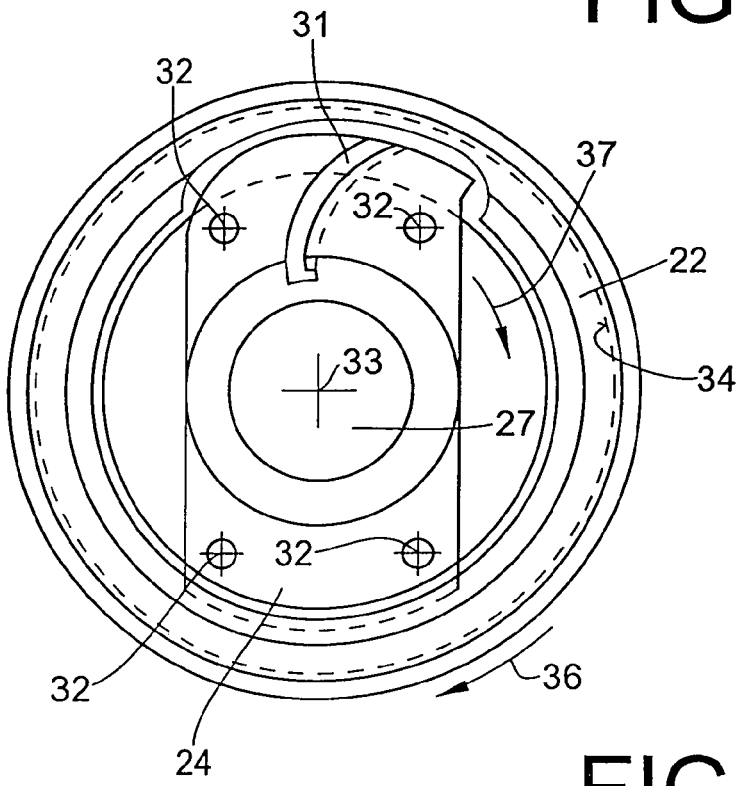
FIG. 3 is a front end view of the spinning rotor of FIG. 2 showing the spinning insert supported therein.

The joined yarn is withdrawn via the yarn withdrawal nozzle 28 and the yarn withdrawal tube 30. The yarn travels through the yarn guide conduit during this time. The withdrawal of the joined yarn causes the spinning insert 24 to be entrained by the yarn. If spinning rotor 21 is accelerated to its operating speed, the spinning insert 24 is also accelerated in the same direction of rotation. The rotational speed of spinning insert 24 of the exemplary embodiment of FIGS. 2 and 3 results to a great extent from the rotational speed of fiber collection groove 34 plus the particular yarn withdrawal speed. A coupling in or out is not necessary. The rotary motion of spinning insert 24 is adjusted automatically.

The present invention is not limited to the exemplary embodiments described. Other embodiments are possible within the scope of the invention, especially as regards the design of the spinning insert. It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, Variations, modifications and equivalent arrangements, the present invention being limited only by the claims appended hereto and the equivalents thereof.

What is claimed is:

1. An open-end spinning device for spinning fibers into a yarn, the spinning device comprising a rotor housing, a spinning rotor disposed for rotation in the rotor housing for receiving the fibers to be spun into the yarn, a spinning insert rotatably supported coaxially with respect to the spinning rotor and a coupling device for contactlessly imparting rotation to the spinning insert as a function of rotation of the spinning rotor for rotation of the spinning insert at a different speed from the spinning rotor under the influence of a shank of the yarn being spun.

2. The open-end spinning device according to claim 1, wherein the coupling device comprises at least one permanent magnet.

3. The open-end spinning device according to claim 2, wherein the permanent magnet is fastened to the spinning insert.

4. The open-end spinning device according to claim 1, wherein the spinning insert comprises a yarn guide conduit having a curvature in the direction of rotation of the spinning rotor.

5. A spinning rotor for spinning fibers into a yarn, the spinning rotor comprising a spinning insert rotatably supported coaxially with respect to the spinning rotor and a coupling device for contactlessly imparting rotation to the spinning insert as a function of rotation of the spinning rotor for rotation of the spinning insert at a different speed from the spinning rotor under the influence of a shank of the yarn being spun.

* * * * *